US010161396B2

(12) United States Patent
Guccione et al.

(10) Patent No.: US 10,161,396 B2
(45) Date of Patent: Dec. 25, 2018

(54) ZERO EMISSION RECIPROCATING DRIVE PUMP

(71) Applicant: Monkey Pumps LLC, Harvey, LA (US)

(72) Inventors: Ray Guccione, Waggaman, LA (US); Richard Marcis, South Lyon, MI (US)

(73) Assignee: Monkey Pumps, LLC, Harvey, LA (US)

( * ) Notice: Subject to any disclaimer, the term of this patent is extended or adjusted under 35 U.S.C. 154(b) by 53 days.

(21) Appl. No.: 14/856,977

(22) Filed: Sep. 17, 2015

(65) Prior Publication Data

US 2017/0082102 A1 Mar. 23, 2017

(51) Int. Cl.

| | |
|---|---|
| ***F04B 53/14*** | (2006.01) |
| ***F04B 9/12*** | (2006.01) |
| ***F04B 9/125*** | (2006.01) |

(52) U.S. Cl.

CPC ..... *F04B 53/143* (2013.01); *F04B 9/12* (2013.01); *F04B 9/125* (2013.01); *F04B 53/14* (2013.01)

(58) Field of Classification Search

CPC ... F04B 2201/0603; F04B 49/22; F04B 19/22
USPC ..... 91/281; 137/625.66–625.69
See application file for complete search history.

(56) References Cited

U.S. PATENT DOCUMENTS

| | | | | |
|---|---|---|---|---|
| 817,538 A | | 4/1906 | Wixon | |
| 2,707,456 A | | 5/1955 | Schweisthal | |
| 2,990,910 A | | 7/1961 | Kimmell | |
| 3,318,251 A | | 5/1967 | Smith | |
| 4,145,165 A | | 3/1979 | Perkins | |
| 4,593,712 A | * | 6/1986 | Quartana, III | F01L 25/063 137/106 |

(Continued)

FOREIGN PATENT DOCUMENTS

| | | |
|---|---|---|
| CA | 1250182 A1 | 2/1989 |
| CN | 202901418 U | 4/2013 |

(Continued)

OTHER PUBLICATIONS

Hi-Tech Seals, U-Cup Selection Guide (2008).*

(Continued)

*Primary Examiner* — Thomas E Lazo
*Assistant Examiner* — Daniel S Collins
(74) *Attorney, Agent, or Firm* — Hankin Patent Law, APC; Kevin Schraven; Anooj Patel

(57) ABSTRACT

A zero emission reciprocating drive pump. The reciprocating drive pump may comprise: a spool and housing assembly. The housing assembly may comprise a flange, spool housing, first chamber, second chamber, and first seal. The flange may attached to a proximal end of the spool housing. The first chamber may be within the flange. The second chamber may be within the spool housing. The spool may be substantially disposed in and reciprocally movable in the second chamber. A proximal end portion of the spool may move reciprocally into and out of the first chamber. The first seal may be positioned substantially adjacent to the first chamber and the second chamber and may contact the proximal end portion of the spool. The flange may comprise a lip that extends substantially along a width of a distal end of the first seal, such that the first seal does not pop out of place.

5 Claims, 4 Drawing Sheets

(56) References Cited

U.S. PATENT DOCUMENTS

| | | | | |
|---|---|---|---|---|
| 4,706,970 | A | | 11/1987 | Ramirez |
| 4,776,773 | A | | 10/1988 | Quartana |
| 5,123,450 | A | | 6/1992 | Wood |
| 5,144,882 | A | | 9/1992 | Weissgerber |
| 5,263,404 | A | | 11/1993 | Gaucher |
| 5,401,148 | A | | 3/1995 | Foster |
| 5,468,127 | A | * | 11/1995 | Elliott ..... F01L 25/063 137/106 |
| 5,469,705 | A | | 11/1995 | Glenn, Jr. |
| 5,788,745 | A | | 8/1998 | Hahn |
| 5,794,442 | A | | 8/1998 | Lisniansky |
| 5,893,707 | A | | 4/1999 | Simmons |
| 5,992,856 | A | | 11/1999 | Balsells |
| 6,006,949 | A | | 12/1999 | Foster |
| 6,183,217 | B1 | | 2/2001 | Elliott |
| 6,280,162 | B1 | | 4/2001 | Scheibel |
| 6,279,471 | B1 | | 8/2001 | Reddoch |
| 6,398,514 | B1 | | 6/2002 | Smith |
| 6,460,407 | B1 | | 8/2002 | Kato |
| 6,736,046 | B2 | | 5/2004 | Elliott |
| 7,458,309 | B2 | | 12/2008 | Simmons |
| 7,640,841 | B2 | | 1/2010 | An |
| 7,980,270 | B2 | | 7/2011 | Bertsch |
| 8,087,345 | B2 | | 1/2012 | Singer |
| 8,167,591 | B1 | | 5/2012 | Sorensen |
| 8,201,580 | B2 | | 6/2012 | Tondolo |
| 8,359,856 | B2 | | 1/2013 | McBride |
| 8,387,574 | B2 | | 3/2013 | McCloy |
| 8,733,102 | B2 | | 5/2014 | Quix |
| 2004/0047749 | A1 | | 3/2004 | Roberts |
| 2005/0220642 | A1 | | 10/2005 | Uno |
| 2008/0131299 | A1 | | 6/2008 | Nakanishi |
| 2010/0314835 | A1 | | 12/2010 | Tackett |
| 2012/0024407 | A1 | | 2/2012 | Kormanik |
| 2013/0318955 | A1 | | 12/2013 | Zhang |
| 2013/0343939 | A1 | | 12/2013 | Stoddard |
| 2014/0123947 | A1 | | 5/2014 | Song |
| 2014/0166139 | A1 | | 6/2014 | Watanabe |
| 2014/0190162 | A1 | | 6/2014 | Fonseca |
| 2014/0271252 | A1 | | 9/2014 | Vines |

FOREIGN PATENT DOCUMENTS

| | | |
|---|---|---|
| KR | 10-2008-0046141 | 5/2008 |
| WO | 2003052270 A1 | 6/2003 |

OTHER PUBLICATIONS

Sidewinder Pumps Inc., Metering Pumps, catalog, United States http://sidewinderpumps.com.

Sidewinder Pumps Inc., Pneumatic Powered Gas Recovery Metering Injection Pump, catalog, United States http://sidewinderpumps.com/gas-recovery.html.

Checkpoint Pumps & Systems, Gas Recovery (GR) Option, catalog, United States http://cppumps.com/GreenEnergy/GasRecoveryGROptions.aspx.

George E King Consulting, Chapter 5: Well Heads, Chokes and SSSVs, data sheet, United States http://gekengineering.com/Downloads/Free_Downloads/Well_Heads_Chokes_SSSV_Chapter_5.pdf.

Nandini Steel, Reducing Flanges, catalog, United States http://www.nspipefittings.com/reducing-flanges.html.

Ideal Vacuum Products, Conflat Flange (CF) Straight, Reducing Nipple, CF 8 inches to 6 inches Stainless Steel, catalog, United States http://www.pchemlabs.com/product.asp?pid=2221.

Bruin Pumps, BRX3 Pneumatically Operated Chemical Injection Pump, catalog, United States http://www.bruinpumps.com/brx3.htm.

PCT International Search Report, dated Nov. 21, 2016.

PCT International Written Opinion, dated Nov. 21, 2016.

* cited by examiner

ZERO EMISSION RECIPROCATING DRIVE PUMP

FIELD OF USE

The present disclosure relates generally to reciprocating drive mechanisms, and more particularly, to reciprocating drive mechanisms for enhancing the maximum supply pressure.

BACKGROUND

Reciprocating drive mechanisms may be used to transport fluids, liquids, and/or gases and are generally used in various applications, such as manufacturing process control, hydraulic systems, and the like. The reciprocating drive mechanism may comprise a spool housed within the pump and is generally configured to move compressed air based on differential pressures within the pump. Specifically, during an upstroke motion, the spool chamber may be pressurized by supply gas, thereby causing the spool to move towards the top cover. On the other hand, during a downstroke motion, the end chamber may compress, which may pressurize the one or more spool chambers with a recovery pressure, thereby causing the spool to move towards the flange of the housing assembly.

In these pump designs, some of the gases used to drive the reciprocating drive mechanism are generally recaptured (i.e., gas recovery) due to mandated environmental laws, as opposed to venting into the atmosphere once the gas is used. As a result, various pump designs have been introduced to capture the gas in different exhaust ports.

Unfortunately, the use of these various pump designs are limited because the supply gas pressure usually must be reduced in order for the pump to function properly. This in turn causes the recaptured gas to also be subsequently reduced. This typically forces the user to again redirect the recovered gas back into a lower pressure system, in order for the recaptured gas to be a reusable.

Importantly, these reciprocating drive mechanism must also use low pressure gas because the seals of these pumps cannot be maintained at higher pressures. These seals may also be subject to excessive wear at higher temperatures, which can ultimately lead to warping. The seals may also lose optimal contact with the spool of the pump. The flanges holding the seal may also not sufficiently hold or retain the seal.

Therefore, there is a need for a design enhancement for a reciprocating pump that will be capable of functioning at higher pressures. Preferably, the new reciprocating drive pump will allow the pump to function at high operating pressure and produce zero emission while preventing the seals from leaving the spool.

SUMMARY OF EMBODIMENTS

To minimize the limitations in the prior art, and to minimize other limitations that will become apparent upon reading and understanding the present disclosure, the present specification discloses a high pressure reciprocating drive mechanism.

One embodiment may be a reciprocating drive mechanism, comprising: a spool and a housing assembly; wherein the housing assembly comprises a flange, a spool housing, a first chamber, a second chamber, and a first seal; wherein the flange is attached to a proximal end of the spool housing; wherein the first chamber is located within the flange;

wherein the second chamber is located substantially within the spool housing; wherein the spool is substantially disposed in and reciprocally movable in the second chamber; wherein a proximal end portion of the spool is configured to move reciprocally into and out of the first chamber; wherein the first seal is positioned substantially adjacent to the first chamber and the second chamber; and wherein the flange comprises a lip, wherein the lip extends substantially along a width of a distal end of the first seal, such that the first seal is substantially prevented from popping out of place. The proximal end portion of the spool may have a length that extends into the first chamber, such that a portion of the proximal end portion of the spool may be continuously within the first chamber while performing an upstroke and a downstroke. The proximal end portion of the spool may have a length that extends approximately to a proximal end of the first seal while performing an upstroke. The housing assembly may further comprise a shoulder gap; wherein the shoulder gap may be located between the flange and a proximal cylindrical portion of the spool and may be present even at a peak of a downstroke of the spool. The housing assembly may further comprise a cover; wherein the cover may be attached at a distal end of the spool housing. The supply pressure of the reciprocating drive pump may be configured to run at a maximum pressure of approximately 1200 psi. The recovery pressure of the reciprocating drive pump may be configured to run at a maximum pressure of approximately 1100 psi. The reciprocating drive mechanism may be a fluid pump.

Another embodiment may be a reciprocating drive mechanism, comprising: a spool and a housing assembly; wherein the housing assembly comprises a flange, a spool housing, a first chamber, a second chamber, a first seal, and a shoulder gap; wherein the flange is attached to a proximal end of the spool housing; wherein the first chamber is located within the flange; wherein the second chamber is located substantially within the spool housing; wherein the spool is substantially disposed in and reciprocally movable in the second chamber; wherein a proximal end portion of the spool is configured to move reciprocally into and out of the first chamber; wherein the first seal is positioned substantially adjacent to the first chamber and the second chamber; and wherein the shoulder gap is located between the flange and a proximal cylindrical portion of the spool and is present even at a peak of a downstroke of the spool. The proximal end portion of the spool may have a length that extends approximately to a proximal end of the first seal while performing an upstroke. The length of the proximal end portion of the spool may cause the shoulder gap to be present at the peak of the downstroke of the spool. The flange may comprise a lip; wherein the lip may extend substantially along a width of a distal end of the first seal, such that the first seal may be substantially prevented from popping out of place. The proximal end portion of the spool may have a length that extends into the first chamber, such that a portion of the proximal end portion of the spool may be continuously within the first chamber while performing an upstroke and a downstroke. The housing assembly may further comprise a cover; wherein the cover may be attached at a distal end of the spool housing. The supply pressure of the reciprocating drive pump may be configured to run at a maximum pressure of approximately 1200 psi. The recovery pressure of the reciprocating drive pump may be configured to run at a maximum pressure of approximately 1100 psi. The shoulder gap may be configured to help prevent the first seal from popping out of place.

Another embodiment may be a reciprocating drive mechanism, comprising: a spool and a housing assembly; wherein the housing assembly comprises a flange, a spool housing, a first chamber, a second chamber, and a first seal; wherein the flange is attached to a proximal end of the spool housing; wherein the first chamber is located within the flange; wherein the second chamber is located substantially within the spool housing; wherein the spool is substantially disposed in and reciprocally movable in the second chamber; wherein a proximal end portion of the spool is configured to move reciprocally into and out of the first chamber; wherein the first seal is positioned substantially adjacent to the first chamber and the second chamber; and wherein the proximal end portion of the spool has a length that extends approximately to a proximal end of the first seal while performing an upstroke. The reciprocating drive mechanism may be a fluid pump. The length of the proximal end portion may substantially prevent the first seal from popping out of place.

Another embodiment may be a reciprocating drive pump, comprising: a spool and a housing assembly; wherein the housing assembly comprises a flange, a spool housing, a first chamber, a second chamber, and a first seal; wherein the flange is attached to a proximal end of the spool housing; wherein the first chamber is located within the flange and has an inner diameter of approximately the same as a diameter of a proximal end portion of the spool; wherein the second chamber is located within the spool housing; wherein the spool is disposed in and reciprocally movable in the second chamber; wherein a proximal end portion of the spool is disposed in and reciprocally movable in the first chamber; wherein the first seal is positioned in-between the first chamber and the second chamber and is configured to receive the proximal end portion of the spool; wherein the flange comprises a lip configured to hold and retain the first seal within the flange; wherein an opening of the lip is configured to receive the proximal end portion of the spool; and wherein the opening of the lip has a diameter at least less than an average diameter of an inner ring diameter and an outer ring diameter of the first seal, such that the lip substantially covers the first seal. The proximal end portion of the spool may have a length that extends at least beyond the first seal while performing an upstroke, such that a portion of the proximal end portion of the spool may be continuously within the first chamber. The housing assembly may further comprise a second seal; wherein the second seal may be positioned near a distal end of the second chamber and may be configured to receive a distal end portion of the spool. The housing assembly may further comprise a cover; wherein the cover may be attached at a distal end of the spool housing, such that the spool contacts the cover during the upstroke of the spool. The housing assembly may further comprise a third seal; wherein the third seal may be positioned near a proximal end of the second chamber. A recovery pressure located within the first chamber may be lower than a supply pressure located within the second chamber. The supply pressure of the reciprocating drive pump may be configured to run at a maximum pressure of approximately 1200 psi. The recovery pressure of the reciprocating drive pump may be configured to run at a maximum pressure of approximately 1100 psi. The reciprocating drive mechanism may be a fluid pump.

Another embodiment may be a reciprocating drive pump, comprising: a spool and a housing assembly; wherein the housing assembly comprises a flange, a spool housing, a first chamber, a second chamber, a first seal, a second seal, and a cover; wherein the flange is attached to a proximal end of the spool housing; wherein the first chamber is located within the flange and has an inner diameter of approximately the same as a diameter of a proximal end portion of the spool; wherein the second chamber is located within the spool housing; wherein the spool is disposed in and reciprocally movable in the second chamber; wherein a proximal end portion of the spool is disposed in and reciprocally movable in the first chamber; wherein the first seal is positioned in-between the first chamber and the second chamber and is configured to receive the proximal end portion of the spool; wherein the flange comprises a lip configured to hold and retain the first seal within the flange; wherein an opening of the lip is configured to receive the proximal end portion of the spool; wherein the opening of the lip has a diameter at least less than an average diameter of an inner ring diameter and an outer ring diameter of the first seal, such that the lip substantially covers the first seal; wherein the proximal end portion of the spool has a length that extends at least beyond the first seal while performing an upstroke, such that a portion of the proximal end portion of the spool is continuously within the first chamber; wherein the second seal is positioned near a distal end of the second chamber and is configured to receive a distal end portion of the spool; wherein the cover is attached at a distal end of the spool housing, such that the spool contacts the cover during the upstroke of the spool; wherein the supply pressure of the reciprocating drive pump is configured to run at a maximum pressure of approximately 1200 psi; and wherein the recovery pressure of the reciprocating drive pump is configured to run at a maximum pressure of approximately 1100 psi. The reciprocating drive mechanism may be a fluid pump.

In a preferred embodiment, the reciprocating drive mechanism may be a reciprocating fluid pump.

It is an object to provide a reciprocating drive mechanism that produces zero emission.

It is an object to provide a reciprocating drive mechanism that may operate at a supply pressure of up to approximately 1,200 pounds per square inch.

It is an object to provide a reciprocating drive mechanism that may operate at a recovery pressure of up to approximately 1,100 pounds per square inch.

It is an object to provide a reciprocating drive mechanism with a spool longer than conventional spools of reciprocating pumps.

It is an object to provide a reciprocating drive mechanism capable of operating without dislodging the seals of the reciprocating drive mechanism at high pressure.

It is an object to provide a reciprocating drive mechanism that allows for recovered gas to be pumped via a high pressure system.

It is an object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE ILLUSTRATIVE EMBODIMENTS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE ILLUSTRATIVE EMBODIMENTS

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", refer to a deviance of between 1-10% from the indicated number or range of numbers.

As used herein, the terms "reciprocal" and "reciprocally" refer to the state of being movable back and forth or to move alternately backwards and forwards.

Figure 1:
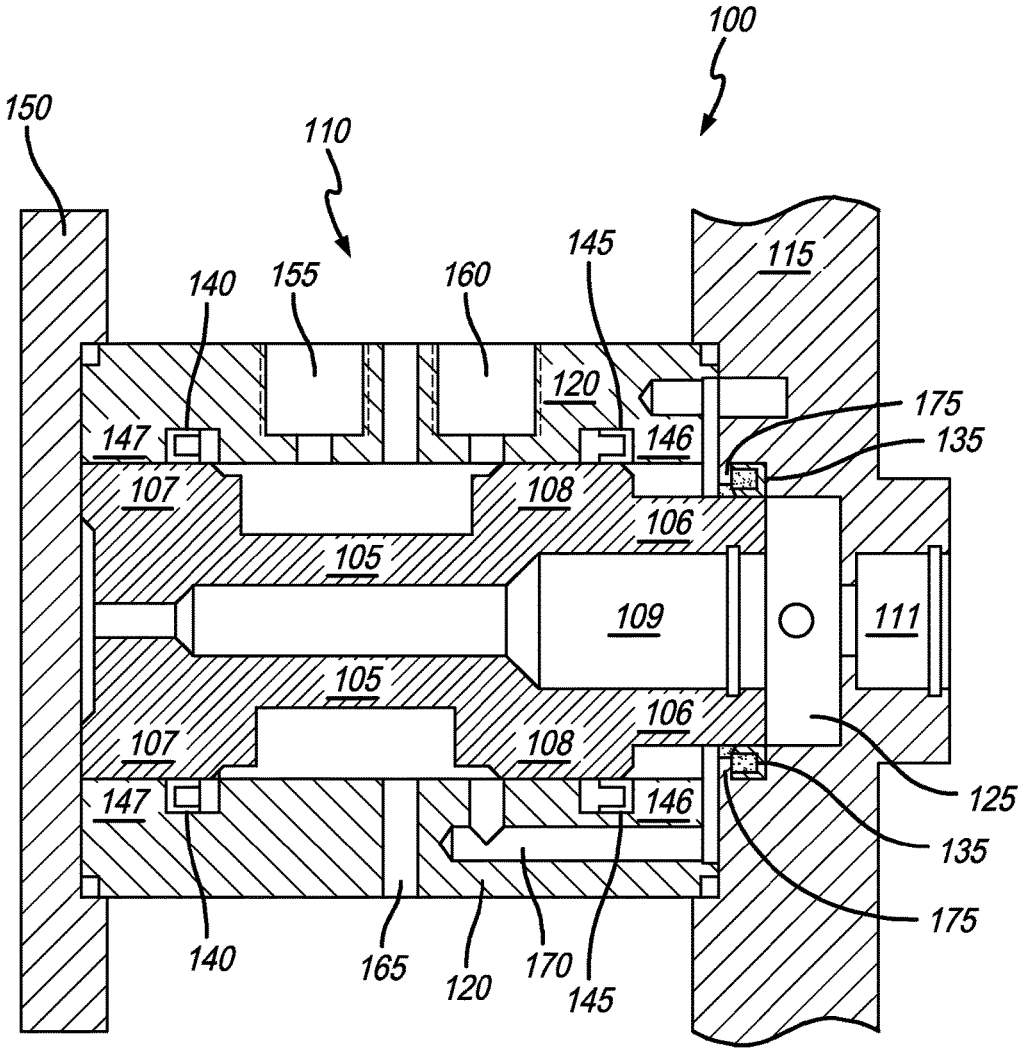
FIG. 1 is an illustration of a cross-section view of one embodiment of the zero emission reciprocating drive mechanism during an upstroke.

FIG. 1 is an illustration of a cross sectional view of one embodiment of the zero emission reciprocating drive mechanism during an upstroke. As shown in FIG. 1, one embodiment of the zero emission reciprocating drive mechanism 100, which may also be referred to as a spool valve, may comprise: a spool 105 and a housing assembly 110. The reciprocating drive mechanism 100 may allow fluid to flow into different paths from one or more sources. The spool 105 may be inside a housing assembly 110, which is preferably a cylinder. The movement of the spool 105 is preferably mechanically or electrically controlled. The movement of the spool 105 generally restricts or permits the flow, thus it controls the fluid flow.

The spool 105 is generally a sliding device that may comprise lands, grooves, and/or slide valves (e.g., d slides). The lands and/or slide valves may block fluid flow through the housing assembly 110, sometimes referred to as a valve body or may allow fluid (liquid or gas) to flow around the spool 105 and through the valve body. Typically, there may be two positions of the reciprocating drive pump 100, a normal position and a working position. The spool 105 is the portion of the valve that controls the direction of hydraulic fluid or gas flow and may comprise one or more spool portions 107, 108, which may secure a slide valve (not shown). For example, a slide valve may be positioned between spool portion 107 and spool portion 108 and adjacent to channels 155 and 160. The slide valve may then alternately block and open channels in the reciprocating drive mechanism 100. The spool 105 may also comprise a proximal end portion 106 that engages with a flange 115 and a channel 109 for allowing gas or fluid to pass.

The housing assembly 110 is generally the main housing or structure that holds and secures the spool 105 and may comprise various components, including: a flange 115, spool housing 120, one or more seals (e.g., first seal 135, second seal 140, third seal 145), and cover 150. The flange 115 may comprise a first chamber 125, and the spool housing 120 may comprise a second chamber 130. Preferably, the spool housing 120 holds and secures the main body of the spool 105 (which may contain one or more D-slides that alternately block and open or ports) via the second chamber 130. The spool housing 120 may also comprise one or more channels 155, 160, 165, 170. The channels 155, 160, 165, 170 may be either blocked or cleared, depending upon the position of the spool 105 in the second chamber 130 (i.e., upstroke versus downstroke). The first chamber 125 of the flange 115 is preferably configured to receive the proximal end portion 106 of the spool 105 when the spool 105 is in the downstroke position.

In one embodiment, the edge of the proximal end portion of the spool 105 may comprise a bevel or chamfer. In that embodiment, the chamfered edge may be between approximately 30 to 50 degrees. In another embodiment, the edge of the proximal end portion of the spool 105 may have a corner radius. In other embodiments, the edge of the proximal end portion of the spool 105 may lack a chamfer, bevel, or corner radius.

FIG. 1 also shows that the zero emission reciprocating drive mechanism 100 may comprise one or more seals for securing gas or fluid within the chambers of the reciprocating drive mechanism 100. For example, in one embodiment, the first seal 135, which is sometimes referred to as spool end seal, may be positioned within the distal portion of the flange 115 and in-between the first chamber 125 and second chamber 130. The first seal 135 may also mate or engage with the proximal end portion 106 of the spool 105. This preferably helps seal the gas or fluid pressure within the first chamber 125. In this embodiment, the second seal 140 may be positioned within the distal portion of the second chamber 130 and may engage with the spool portion 107 of the spool 105. Similarly, the third seal 145 may be positioned near the proximal portion 146 of the second chamber 130 and may engage with the spool portion 108 of the spool 105. Preferably, a lip 175 is positioned over the first seal 135 to hold and secure the first seal 135. In one embodiment, the opening of the lip 175 may have a diameter of at least less than an average diameter of an inner ring diameter and an outer ring diameter of the first seal 135, such that the lip 175 substantially covers the first seal 135. In a preferred embodiment, the lip 175 may extend to a length of at least 50% of the width of the first seal 135, such that at least 50% of the first seal 135 is covered by the lip 175. In another embodiment, the lip 175 may extend to a length of at least 75% of the width of the first seal 135, such that at least 75% of the first seal 135 is covered by the lip 175. These embodiments may help allow the lip 175 to prevent the first seal 135 from popping out of place or blowing over, especially when dealing with a high pressures of up to approximately 1,200 pounds per square inch. Although FIG. 1 only shows three seals, any number of seals may be used.

FIG. 1 also shows that the housing assembly 110 may comprise a cover 150 and flange 115. In one embodiment, the cover 150 may be attached to a distal end 147 of the spool housing 120, and the flange 115 may be attached to the proximal end 146 of the spool housing 120.

FIG. 1 also shows that the spool 105 and housing assembly 110 may comprise one or more channels. Specifically, channels 155, 160, 165, 170 may be located inside the spool housing 120 and may comprise openings that provides fluid or gas access to the first chamber 125 and/or second chambers 130. Similarly, in another embodiment, channel 109 may be located within the spool 105, and channel 111 may be located within the flange 115. Channel 109 and channel 111 may provide fluid or gas access to one another. Channel 109 and channel 111 may also provide housing for other components such as a rod. In various embodiments, channel 109 and/or channel 111 may also be in fluid/gas communication with channels 155, 160, 165, 170, depending upon whether the spool 105 is in the upstroke or downstroke position.

Figure 2:
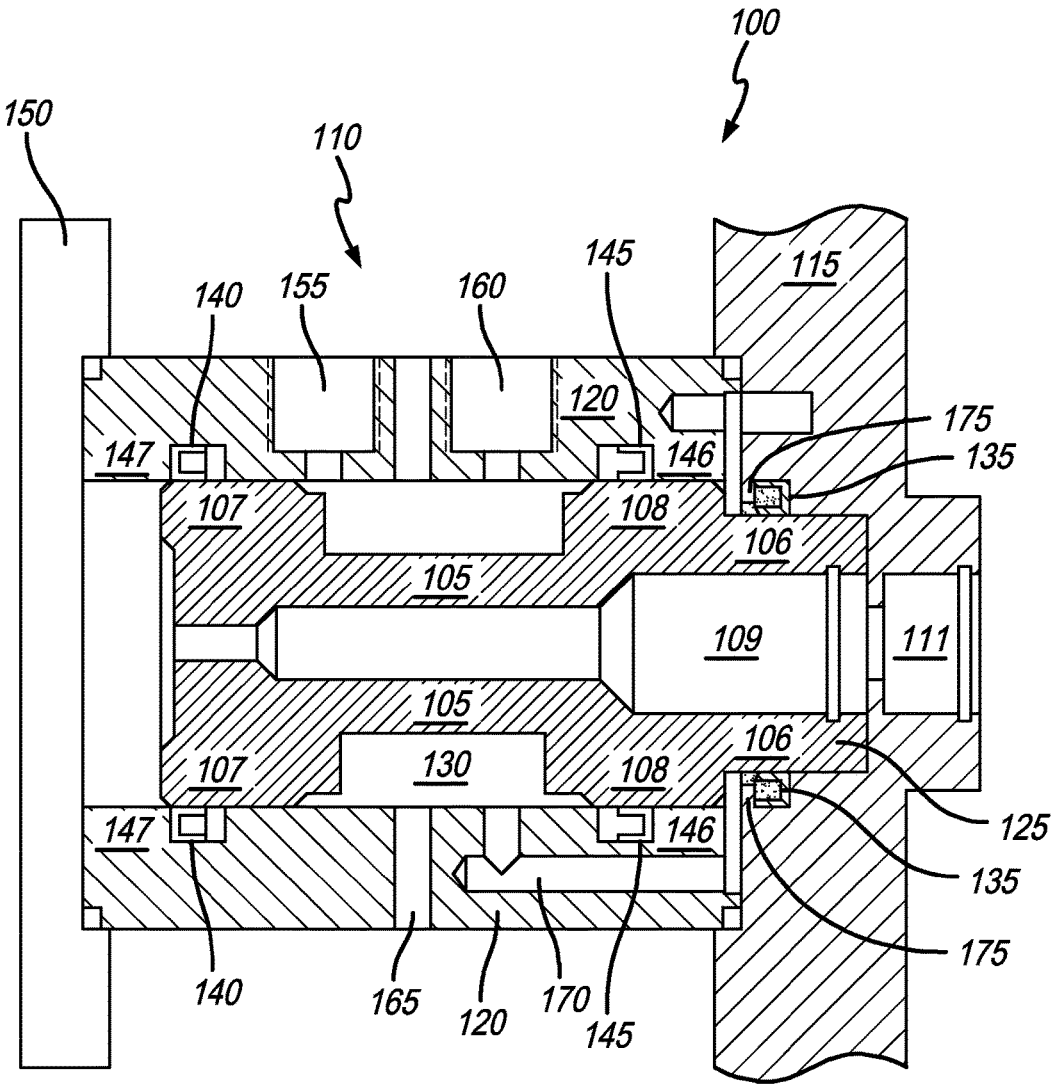
FIG. 2 is an illustration of a cross-section view of one embodiment of the zero emission reciprocating drive mechanism during a downstroke.

The spool 105 may also transition between a first position (i.e., upstroke, as shown in FIG. 1), and a second position (i.e., downstroke, as shown in FIG. 2). Specifically, the spool 105 may move upwards towards the cover 150 during an upstroke. The spool 105 may also move downwards towards the flange 115 during a downstroke. This movement of the spool 105 may occur through various mechanisms, including mechanical (e.g., piston, rod), gas pressure (e.g., introduction of gas), fluid pressure, electrical actuation, and the like. For example, in one embodiment, supply pressure within the second chamber 130 may cause the spool 105 to move in either in the upstroke or downstroke position.

FIG. 2 is an illustration of a cross sectional view of one embodiment of the zero emission reciprocating drive mechanism during a downstroke. As shown in FIG. 2, one embodiment of the zero emission reciprocating drive mechanism 100 may comprise: a spool 105 and a housing assembly 110. The housing assembly 110 may comprise: a flange 115, spool housing 120, first seal 135, second seal 140, third seal 145, cover 150, and channels 155, 160, 165, 170. The spool 105 may comprise spool portions 107, 108, channel 109, and a proximal end portion 106. FIG. 2 also shows the spool 105 in the downstroke position. Importantly, FIG. 2 shows that, unlike conventional reciprocating drive mechanisms, the diameter of the opening of the lip 175 of the flange 115 is almost the same diameter of the proximal end portion 106 of the spool 105. This smaller diameter of the lip 175 preferably reduces the clearance between the flange 115 and the spool 105, and thus, helps retain the first seal 135 from blowing out, when the zero emission reciprocating drive mechanism 100 is subject to higher pressure in the first chamber 125.

Importantly, FIG. 2 also shows that the proximal end portion 106 of the spool 105 may be lengthened. This modification to the spool 105 preferably allows the spool 105 to immediately contact the flange 115 during the downstroke. Additionally, during the upstroke, the longer length prevents the first seal 135 from leaving or popping out of the end of the spool 105.

By (1) providing a smaller lip diameter and (2) lengthening of the proximal end portion 106 of the spool 105, the likelihood of the first seal 135 from blowing off the spool 105 is substantially reduced. As such, the reciprocating drive mechanism 100 may operate with zero emissions and at a much higher supply pressure and recovery pressure. In one embodiment, the supply pressure may be higher than the recovery pressure. For example, in a preferred embodiment, the supply pressure of the reciprocating drive pump 100 may operate at a maximum pressure of approximately 1200 psi. Similarly, in another preferred embodiment, the recovery pressure of the reciprocating drive pump 100 may also operate at a maximum pressure of approximately 1100 psi.

Figure 3:
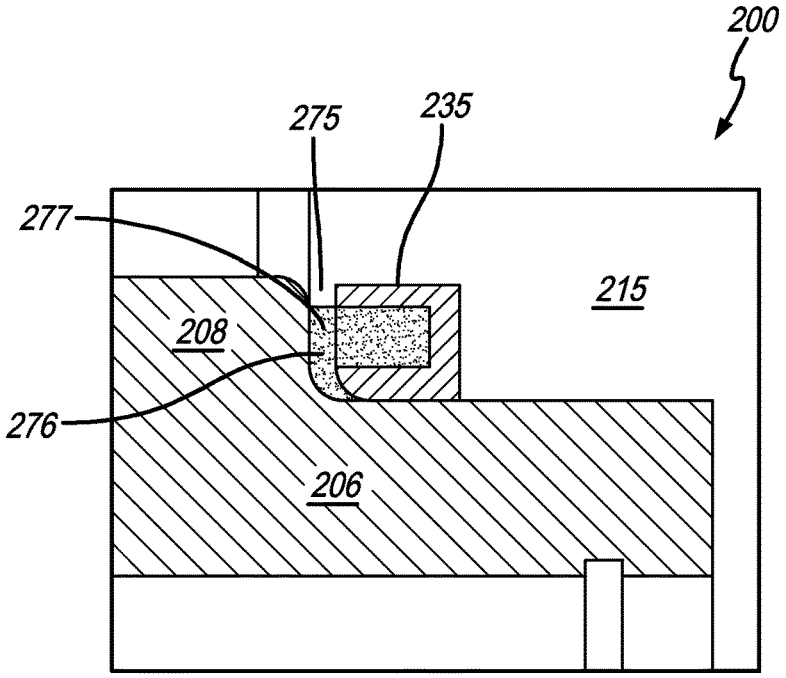
FIG. 3 PRIOR ART
FIG. 3 is a close up illustration of a cross-section view of the first seal, spool, and flange of a conventional reciprocating drive mechanism during the downstroke.

FIG. 3 is a close up illustration of a cross sectional view of the first seal, spool, and flange of a conventional reciprocating drive mechanism during the downstroke. FIG. 3 shows the two standard features relating to first seal 235 popping or blowing during the reciprocation of the spool when pressure is high. The first is a short lip 275 and the second is a short proximal end portion of 206. As shown in FIG. 3, the lip 275 of a conventional reciprocating drive mechanism 200 is generally shorter, and thus, provides for a larger gap 276 or clearance, which may result in the first seal popping. Additionally, the length of the proximal end portion 206 of a conventional spool, as shown, is not lengthened. The shorter length of a conventional spool may also cause the first seal to pop off. First, the spool portion 208 of a conventional spool may contact (or get very, very close to) the flange 215 or the first seal 235 during a downstroke. This is shown by shoulder gap 277 being very small or non-existent. The close proximity of the cylindrical spool portion 208 of a conventional spool to the flange 215 and small or non-existent shoulder gap 277 may cause a suction force in shoulder gap 277, which may cause the first seal 235 to pop off and move towards shoulder gap 277. Alternatively, during the upstroke, the shorter length of the proximal end portion 206 of a conventional spool may cause the first seal 235 to possibly leave the end of the spool, as shown in FIG. 5, and move towards a proximal end of the flange 215.

Figure 4:
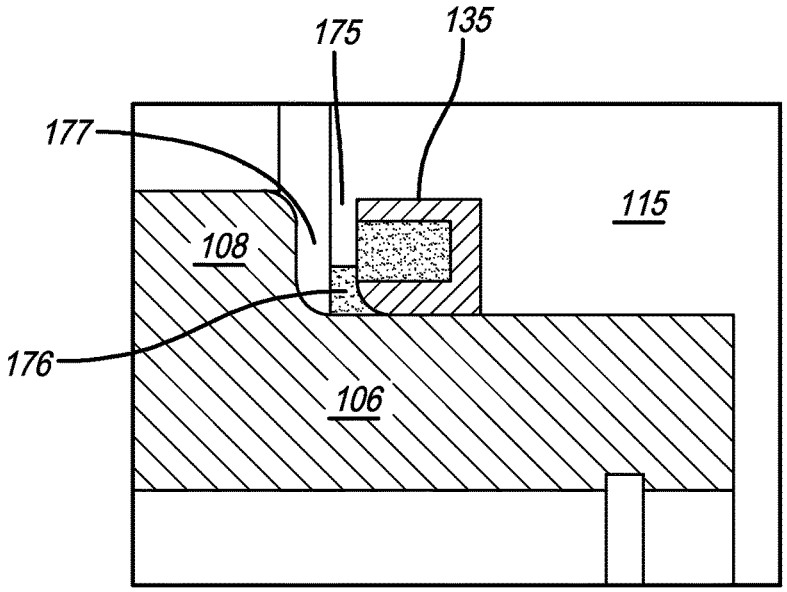
FIG. 4 is a close up illustration of a cross-section view of one embodiment of the first seal, spool, and flange of a zero emission reciprocating drive mechanism during the downstroke.

FIG. 4 is a close up illustration of a cross sectional view of one embodiment of the first seal, spool, and flange of a zero emission reciprocating drive mechanism during the downstroke. FIG. 4 shows a longer lip 175 and a longer proximal end portion 106. As shown in FIG. 4, the length of the lip 175 of a reciprocating drive mechanism 100 is preferably longer, thereby providing little or no clearance or gap 176. Additionally, the length of the proximal end portion 106 of a spool 105 is preferably longer, which helps prevent a first seal 135 from leaving the end of the spool 105 during the upstroke, because cylindrical spool portion 108 is further away from flange 115 and/or further away from the first seal 135. This is because shoulder gap 177 is wider and thus, in an upstroke, the suction force on the first seal 135 is lessened. Moreover, because the proximal end portion 106 is longer, at the peak of the upstroke, the proximal end portion 106 covers the first seal 135 (as shown in FIG. 6) such that the first seal 135 is much less likely to pop out of place.

Figure 5:
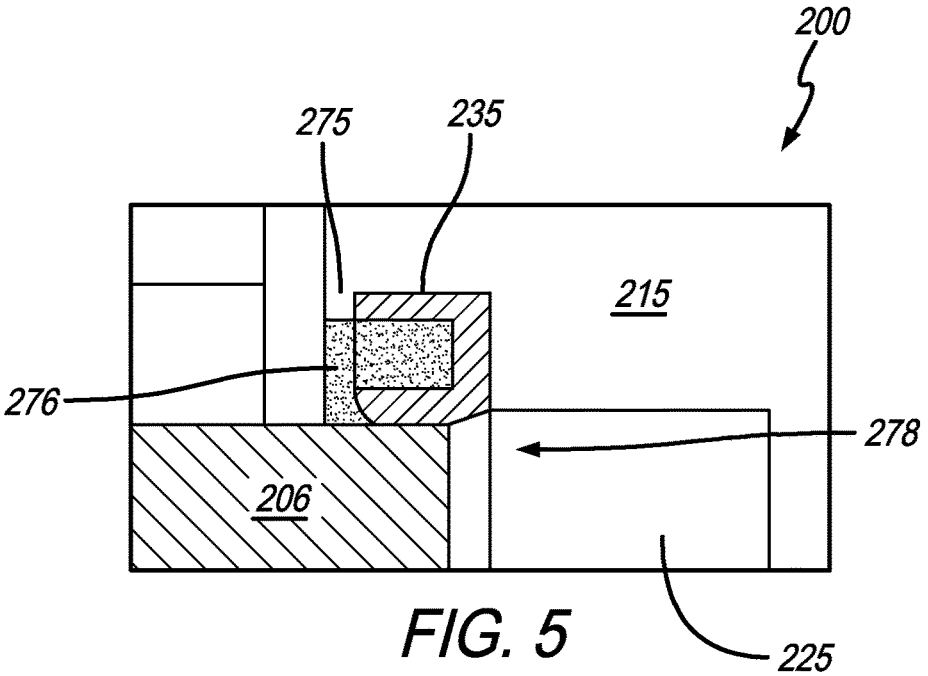
FIG. 5 PRIOR ART
FIG. 5 is close up illustration of a cross-section view of the first seal, spool, and flange of a conventional reciprocating drive mechanism during the upstroke.

FIG. 5 is close up illustration of a cross sectional view of the first seal, spool, and flange of a conventional reciprocating drive mechanism during the upstroke. As shown in FIG. 5, the lip 275 of a conventional reciprocating drive mechanism 200 is generally short, and thus, provides a large gap 276 between the flange 215 and the proximal end portion 206 of the spool. At high pressures, this large gap 276 may allow the first seal 235 to pop out of place. Additionally, the length of the proximal end portion 206 of a conventional spool is short. Thus, during the upstroke of the spool, the shorter length may cause the first seal 235 to possibly pop out of the end of the spool at the bottom of gap 278, and possibly into the first chamber 225. Alternatively, during the downstroke of the spool, the short length may also cause the first seal 235 to blow out distally due to pressures coming from bottom gap 278.

Figure 6:
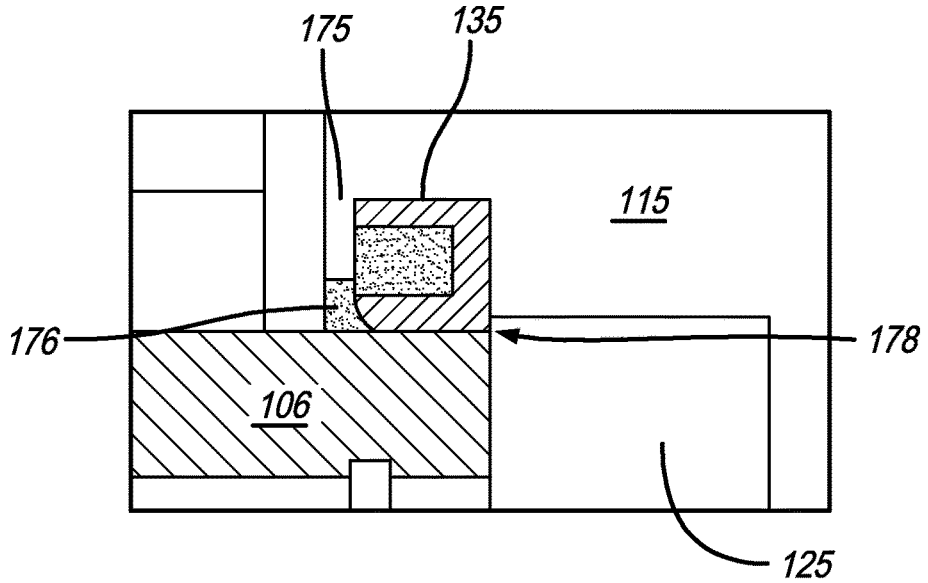
FIG. 6 is close up illustration of a cross-section view of one embodiment of the first seal, spool, and flange of a zero emission reciprocating drive mechanism during the upstroke.

FIG. 6 is close up illustration of a cross sectional view of one embodiment of the first seal, spool, and flange of a zero emission reciprocating drive mechanism during the upstroke, according to the claimed invention. As shown in FIG. 6, lip 175 of a reciprocating drive mechanism 100 is preferably longer, thereby providing little or no clearance or gap 176 between the flange 115 and the proximal end portion 106 of the spool 105. Additionally, the length of the proximal end portion 106 of a spool 105 is preferably longer, which covers the first seal 135 and helps prevent the first seal 135 from popping out of the end of the spool 105 though end gap 178 during the upstroke. This also helps preventing the first seal 135 from blowing out distally during the downstroke or upstroke of the spool.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A zero emission reciprocating drive mechanism, comprising:

a spool; and a housing assembly;

wherein said housing assembly comprises a flange, a spool housing, a first chamber, a second chamber, a first seal, a second seal, and a third seal;

wherein said flange is attached to a proximal end of said spool housing;

wherein said first chamber is located within said flange;

wherein said second chamber is located within said spool housing;

wherein said spool is disposed in and reciprocally movable in said second chamber;

wherein a proximal end portion of said spool is configured to move reciprocally into and out of said first chamber;

wherein said first seal is positioned adjacent to said first chamber and said second chamber;

wherein said flange comprises a lip, wherein said lip extends along a width of a distal end of said first seal;

wherein at least 75% of said first seal is covered by said lip;

wherein said proximal end portion of said spool has a length that extends into said first chamber, such that a portion of said proximal end portion of said spool is continuously within said first chamber while performing an upstroke and a downstroke;

wherein said proximal end portion of said spool has a length that extends to a proximal end of said first seal while performing said upstroke;

wherein said housing assembly further comprises a shoulder gap;

wherein said shoulder gap is located between said flange and a proximal cylindrical portion of said spool and is present even at a peak of said downstroke of said spool;

wherein said first seal is prevented from popping out of place at pressures greater than 800 psi by the presence of said lip, said shoulder gap; and said proximal end portion of said spool having said length that extends to said proximal end of said first seal while performing said upstroke; and wherein a side of said spool covers all of said second and third seals during the peaks of said upstroke and downstroke.

2. The zero emission reciprocating drive mechanism of claim 1, wherein said housing assembly further comprises a cover;

wherein said cover is attached at a distal end of said spool housing.

3. The zero emission reciprocating drive mechanism of claim 1, wherein said supply pressure of said reciprocating drive pump is configured to run at a maximum pressure of approximately 1200 psi.

4. The zero emission reciprocating drive mechanism of claim 1, wherein said recovery pressure of said reciprocating drive pump is configured to run at a maximum pressure of approximately 1100 psi.

5. The zero emission reciprocating drive mechanism of claim 1, wherein said zero emission reciprocating drive mechanism is a fluid pump.

* * * * *